US010876354B2

(12) United States Patent
Rivera

(10) Patent No.: US 10,876,354 B2
(45) Date of Patent: Dec. 29, 2020

(54) SYSTEM AND METHOD FOR SELECTING AND IMPLEMENTING POWER AND MOTION PARAMETERS OF A ROLLER SHADE MOTOR BASED ON LOAD

(71) Applicant: Crestron Electronics Inc., Rockliegh, NJ (US)

(72) Inventor: Luis Rivera, Dumont, NJ (US)

(73) Assignee: Crestron Electronics, Inc., Rockleigh, NJ (US)

( * ) Notice: Subject to any disclaimer, the term of this patent is extended or adjusted under 35 U.S.C. 154(b) by 249 days.

(21) Appl. No.: 15/447,325

(22) Filed: Mar. 2, 2017

(65) Prior Publication Data

US 2018/0252036 A1 Sep. 6, 2018

(51) Int. Cl.
*E06B 9/72* (2006.01)
*E06B 9/68* (2006.01)

(52) U.S. Cl.
CPC ..... *E06B 9/72* (2013.01); *E06B 2009/6809* (2013.01); *E06B 2009/6854* (2013.01)

(58) Field of Classification Search
CPC ..... E06B 2009/6809; E06B 2009/6854; E06B 2009/6845; E06B 9/72; B60K 1/00; B60K 5/00; B60K 6/00; H01H 3/26; B04B 13/003
USPC ..... 318/3, 4
See application file for complete search history.

(56) References Cited

U.S. PATENT DOCUMENTS 5,850,131 A * 12/1998 Wolfer ..... E06B 9/88 318/466
6,111,376 A * 8/2000 Jean-Marc ..... E04F 10/0648 318/432
6,215,265 B1 * 4/2001 Wolfer ..... E06B 9/72 160/310
6,465,980 B1 * 10/2002 Orsat ..... E06B 9/82 160/130
2002/0190678 A1 * 12/2002 Huber ..... E06B 9/32 318/434
2003/0075283 A1 * 4/2003 Collett ..... E06B 9/262 160/84.02
2003/0201073 A1 * 10/2003 Dieckmann ..... E04F 10/0607 160/66
2005/0039863 A1 * 2/2005 Bruno ..... E06B 9/80 160/130
2005/0039865 A1 * 2/2005 Bruno ..... E06B 9/80 160/310

(Continued)

FOREIGN PATENT DOCUMENTS

FR 2816465 A1 * 5/2002 ..... E06B 9/88

*Primary Examiner* — Kyle J. Walraed-Sullivan
(74) *Attorney, Agent, or Firm* — Crestron Electronics, Inc.

(57) ABSTRACT

A system and method are provided herein for adjusting a set of roller shade motor motion parameters of a shade motor for use in a roller shade, the systems and method comprising: engaging the shade motor to move the roller shade a first distance; measuring a first torque level indicator in regard to a power supply voltage being supplied to the shade motor; determining a first torque level based on the measured first torque lever indicator; obtaining a first set of roller shade motor motion parameters from a table based on the first torque level; and applying the first set of roller shade motor motion parameters to the shade motor whenever the roller shade is directed to lift or lower the roller shade.

15 Claims, 7 Drawing Sheets

(56) References Cited

U.S. PATENT DOCUMENTS

| | | | | |
|---|---|---|---|---|
| 2008/0257504 | A1* | 10/2008 | Marchetto | E06B 9/88 160/311 |
| 2009/0165779 | A1* | 7/2009 | Hoff | E04F 10/0651 126/572 |
| 2010/0231156 | A1* | 9/2010 | Grehant | E06B 9/88 318/561 |
| 2010/0280666 | A1* | 11/2010 | Marchetto | E04F 10/0659 700/275 |
| 2012/0053731 | A1* | 3/2012 | Feldstein | E06B 9/42 700/275 |
| 2013/0199735 | A1* | 8/2013 | Colson | E06B 9/42 160/2 |
| 2014/0224437 | A1* | 8/2014 | Colson | E06B 9/42 160/291 |
| 2015/0191971 | A1* | 7/2015 | Cavarec | E06B 9/40 160/310 |
| 2015/0275574 | A1* | 10/2015 | Derk, Jr. | E06B 9/50 160/1 |
| 2016/0138333 | A2* | 5/2016 | Bohlen | E06B 9/62 160/310 |
| 2017/0112316 | A1* | 4/2017 | Rivera | A47H 5/02 |
| 2018/0171711 | A1* | 6/2018 | Desfossez | E06B 9/40 |
| 2018/0171712 | A1* | 6/2018 | Desfossez | E06B 9/40 |
| 2019/0119984 | A1* | 4/2019 | Mugnier | E04F 10/0618 |

* cited by examiner

FIG. 5

| *T*-Value ($\tau_v$) | PID Value | PID Sampling Frequency ($f_s$) | Minimum Speed ($V_s$) | Minimum Power ($P_m$) | Commutation Method ($C_m$) | Ramp-Up Boost ($R_{ub}$) | Ramp-Down Boost ($R_{db}$) | |
|---|---|---|---|---|---|---|---|---|
| $\tau_a$ | P:<br>I:<br>D: | $f_s =$ | $V_s =$ | $P_m =$ | $C_m =$ | $R_{ub} =$ | $R_{db} =$ | |
| $\tau_{vb}$ | P:<br>I:<br>D: | $f_s =$ | $V_s =$ | $P_m =$ | $C_m =$ | $R_{ub} =$ | $R_{db} =$ | |
| $\tau_{vc}$ | P:<br>I:<br>D: | $f_s =$ | $V_s =$ | $P_m =$ | $C_m =$ | $R_{ub} =$ | $R_{db} =$ | |
| $\tau_{vd}$ | P:<br>I:<br>D: | $f_s =$ | $V_s =$ | $P_m =$ | $C_m =$ | $R_{ub} =$ | $R_{db} =$ | |
| ⋮ | ⋮ | ⋮ | ⋮ | ⋮ | ⋮ | ⋮ | ⋮ | |
| $\tau_{vn}$ | P:<br>I:<br>D: | $f_s =$ | $V_s =$ | $P_m =$ | $C_m =$ | $R_{ub} =$ | $R_{db} =$ | |
| | | | | | | | | |

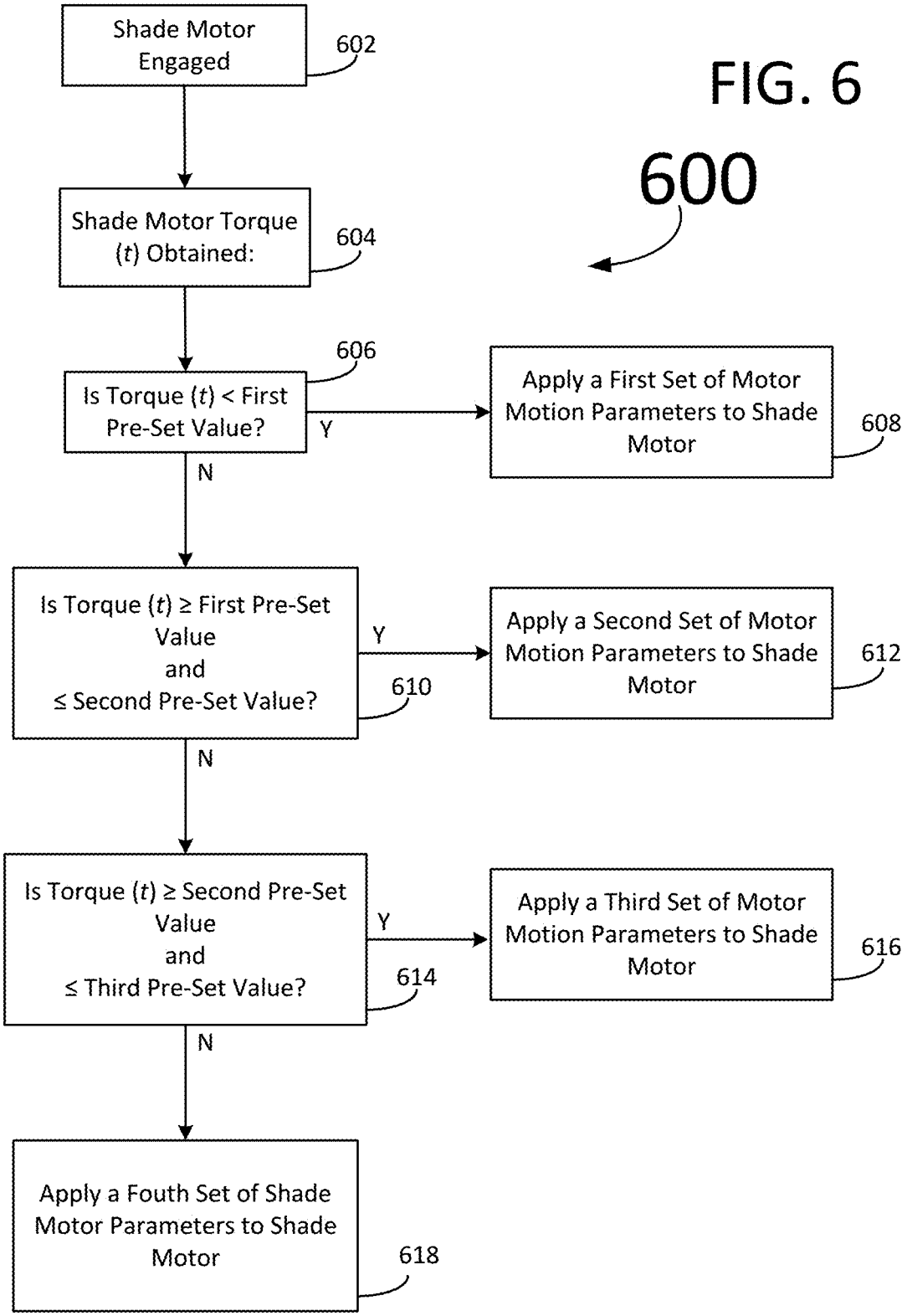
Shade Motor Engaged
602
FIG. 6
600
Shade Motor Torque (t) Obtained:
604
606
Is Torque (t) < First Pre-Set Value?
Y
Apply a First Set of Motor Motion Parameters to Shade Motor
608
N
Is Torque (t) ≥ First Pre-Set Value and ≤ Second Pre-Set Value?
Y
Apply a Second Set of Motor Motion Parameters to Shade Motor
612
610
N
Is Torque (t) ≥ Second Pre-Set Value and ≤ Third Pre-Set Value?
Y
Apply a Third Set of Motor Motion Parameters to Shade Motor
616
614
N
Apply a Fouth Set of Shade Motor Parameters to Shade Motor
618

SYSTEM AND METHOD FOR SELECTING AND IMPLEMENTING POWER AND MOTION PARAMETERS OF A ROLLER SHADE MOTOR BASED ON LOAD

BACKGROUND

Technical Field

The embodiments described herein relate generally to roller shades, and more specifically to systems, methods, and modes for selecting and implementing power and motion parameters of a roller shade motor such that a single roller shade motor can be used for raising and lowering a plurality of different roller shades of different weights and sizes, fluidly and without faulty operation, substantially regardless of the size and weight of the roller shade.

Background Art

Given a decent economic outlook, and reasonable expectations of continued employment, Americans like to and will invest in their homes, as it is traditionally one of the safest and best investments that can be made by people of the middle and upper classes. In 2015, Americans spent about $14 billion on interior design work. There are many components to interior design: flooring (tiles, carpets, hardwood, and other materials), wall coverings (paint, wallpaper, among others), furniture, fixtures, lighting products, environmental controls, accoutrements, and window coverings and treatments, among others.

Of the latter-most category, window coverings and treatments, there are several different types. For example, shades, curtains, and blinds are among the most popular types. Of these most popular types, motorized roller shades provide a convenient one-touch control solution for screening windows, doors, or the like, to achieve privacy and thermal effects. A motorized roller shade typically includes a rectangular shade material attached at one end to a cylindrical rotating tube, called a roller tube, and at an opposite end to a hem bar. The shade material is wrapped around the roller tube. An electric motor, either mounted inside the roller tube or externally coupled to the roller tube, rotates the roller tube to unravel the shade material to cover a window and reverse rotation to uncover the window.

Roller shades can have different sizes and loads; based on the load there can be particular power needs and different approaches for controlling the smoothness and precision of the shade's travel. Large heavy shades can be difficult to control because of the large torque requirements needed to initiate and maintain smooth motion. Similarly, with respect to small and light shades, a motor that is too powerful, or that applies too much torque, can cause substantially similar jerky movements. As those of skill in the art can appreciate, many windows in a house can have similarly sized width dimensions, but have varying heights, or can have similarly sized height dimensions, but of varying heights. In either case, the loads of the roller shades can vary from window-to-window. Shade manufacturers, for reasons of economy and efficiency, would prefer to stock as few components as possible, include shade motors. Having multiple depending the size/weight of the shades increases component counts, and storage/inventory costs. In addition, having multiple types of motors for relatively similar looking installation sites can lead to errors in installation that can then lead to motor damage and/or unsafe situations (e.g., motors overheating and catching fire).

Accordingly, a need has arisen for systems, methods, and modes for selecting and implementing power and motion parameters of a roller shade motor such that a single roller shade motor can be used for raising and lowering a plurality of different roller shades of different weights and sizes, fluidly and without faulty operation, substantially regardless of the size and weight of the roller shade.

SUMMARY

It is an object of the embodiments to substantially solve at least the problems and/or disadvantages discussed above, and to provide at least one or more of the advantages described below.

It is therefore a general aspect of the embodiments to provide systems, methods, and modes for selecting and implementing power and motion parameters of a roller shade motor such that a single roller shade motor can be used for raising and lowering a plurality of different roller shades of different weights and sizes, fluidly and without faulty operation, substantially regardless of the size and weight of the roller shade, in a manner that will obviate or minimize problems of the type previously described.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Further features and advantages of the aspects of the embodiments, as well as the structure and operation of the various embodiments, are described in detail below with reference to the accompanying drawings. It is noted that the aspects of the embodiments are not limited to the specific embodiments described herein. Such embodiments are presented herein for illustrative purposes only. Additional embodiments will be apparent to persons skilled in the relevant art(s) based on the teachings contained herein.

According to a first aspect of the embodiments, a method for adjusting a set of roller shade motor motion parameters of a shade motor for use in a roller shade, is provided, the method comprising: engaging the shade motor to move the roller shade a first distance; measuring a first torque level indicator in regard to a power supply voltage being supplied to the shade motor; determining a first torque level based on the measured first torque lever indicator; obtaining a first set of roller shade motor motion parameters from a table based on the first torque level; and applying the first set of roller shade motor motion parameters to the shade motor whenever the roller shade is directed to lift or lower the roller shade.

According to the first aspect of the embodiments, the step of engaging comprises engaging the shade motor to raise the roller shade a first height.

According to the first aspect of the embodiments, the step of engaging comprises: engaging the shade motor to lower the roller shade a first height.

According to the first aspect of the embodiments, the first distance equals a first upward movement distance and a first downward movement distance.

According to the first aspect of the embodiments, the first torque level indicator comprises a first current level in a power supply voltage being supplied to the shade motor during movement of the roller shade over the first distance.

According to the first aspect of the embodiments, the steps of engaging and measuring comprise: engaging the shade motor to lift the roller shade a first height and measuring a shade-up current level; engaging the shade motor to lower the roller shade a second height and measuring a shade-down current level; averaging the shade-up current level and shade-down current level to determine an average current level; and determining a shade motor torque level based on the average current level.

According to the first aspect of the embodiments, the current-torque table comprises: a plurality of motor motion parameters for each of n different ranges of torque values.

According to the first aspect of the embodiments, the motor motion parameters comprises: at least one of (a) a set of proportional, integrative, and derivative (PID) values, (b) a PID sampling frequency; (c) a minimum speed of the roller shade motor; a commutation method; (d) a ramp-up boost value; and (e) a ramp-damp boost value.

According to the first aspect of the embodiments, the first torque level indicator comprises: a first phase shift difference measured between the current input to a power supply voltage being supplied to the shade motor during movement of the roller shade over the first distance, and a shaft angular position, the shaft used to rotationally raise and lower the roller shades.

According to the first aspect of the embodiments, the steps of engaging and measuring comprise: engaging the shade motor to lift the roller shade a first height and measuring a shade-up current level; engaging the shade motor to lower the roller shade a second height and measuring a shade-down current level; averaging the shade-up current level and shade-down current level to determine an average current level; and determining a shade motor torque level based on the average current level.

According to the first aspect of the embodiments, the current-torque table comprises: a plurality of motor motion parameters for each of n different ranges of torque values.

According to the first aspect of the embodiments, the motor motion parameters comprises: at least one of (a) a set of proportional, integrative, and derivative (PID) values, (b) a PID sampling frequency; (c) a minimum speed of the roller shade motor; a commutation method; (d) a ramp-up boost value; and (e) a ramp-damp boost value.

According to a second aspect of the embodiments, a roller shade motor controller system is provided, comprising: a roller shade; a roller shade motor adapted to move the roller shade upon receipt of roller shade motor motion commands; and a roller shade motor controller adapted to issue a first roller shade motor motion command to move the roller shade a first distance, measure a first torque level indicator in regard to a power supply voltage being supplied to the roller shade motor, determine a first torque level based on the measured first torque level indicator, obtain a first set of roller shade motor motion parameters from a table based on the first torque level, and apply the first set of roller shade motor motion parameters to the roller shade motor in a subsequent roller shade motor motion command whenever the roller shade motor is directed to raise or lower the roller shade.

According to the second aspect of the embodiments, the first roller shade motor motion command comprises: a roller shade motor motion command to raise the roller shade a first height.

According to the second aspect of the embodiments, the first roller shade motor motion command comprises a roller shade motor motion command to lower the roller shade a first height.

According to the second aspect of the embodiments, the first distance equals a first upward movement distance and a first downward movement distance.

According to the second aspect of the embodiments, the first torque level indicator comprises a first current level in a power supply voltage being supplied to the shade motor during movement of the roller shade over the first distance.

According to the second aspect of the embodiments, the roller shade motor is further adapted to engage the shade motor to lift the roller shade a first height and measuring a shade-up current level, engage the shade motor to lower the roller shade a second height and measuring a shade-down current level, average the shade-up current level and shade-down current level to determine an average current level, and determine a shade motor torque level based on the average current level.

According to the second aspect of the embodiments, the current-torque table comprises a plurality of motor motion parameters for each of n different ranges of torque values.

According to the second aspect of the embodiments, the motor motion parameters comprises: at least one of (a) a set of proportional, integrative, and derivative (PID) values, (b) a PID sampling frequency; (c) a minimum speed of the roller shade motor; a commutation method; (d) a ramp-up boost value; and (e) a ramp-damp boost value.

According to the second aspect of the embodiments, the first torque level indicator comprises a first phase shift difference measured between the current input to a power supply voltage being supplied to the shade motor during movement of the roller shade over the first distance.

According to the second aspect of the embodiments, the roller shade motor controller is further adapted to engage the shade motor to raise the roller shade a first height and measure a shade-up current level, engage the shade motor to lower the roller shade a second height and measure a shade-down current level, average the shade-up current level and shade-down current level to determine an average current level, and determine a shade motor torque level based on the average current level.

According to the second aspect of the embodiments, the current-torque table comprises a plurality of motor motion parameters for each of n different ranges of torque values.

According to the second aspect of the embodiments, the motor motion parameters comprises at least one of (a) a set of proportional, integrative, and derivative (PID) values, (b) a PID sampling frequency; (c) a minimum speed of the roller shade motor; a commutation method; (d) a ramp-up boost value; and (e) a ramp-damp boost value.

BRIEF DESCRIPTION OF THE DRAWINGS

The above and other objects and features of the embodiments will become apparent and more readily appreciated from the following description of the embodiments with reference to the following figures. Different aspects of the embodiments are illustrated in reference figures of the drawings. It is intended that the embodiments and figures disclosed herein are to be considered to be illustrative rather than limiting. The components in the drawings are not necessarily drawn to scale, emphasis instead being placed upon clearly illustrating the principles of the aspects of the embodiments. In the drawings, like reference numerals designate corresponding parts throughout the several views.

FIG. 5 illustrates a look-up table for determining motor motion parameters based on motor load torque according to aspects of the embodiments.

FIG. 6 illustrates a flow chart of a method for selecting and implementing power and motion parameters of a roller shade motor based on load, such that the motor of the roller shade can be controlled using the motor controller as illustrated in FIGS. 1 and 2 according to aspects of the embodiments.

DETAILED DESCRIPTION

Figure 1:
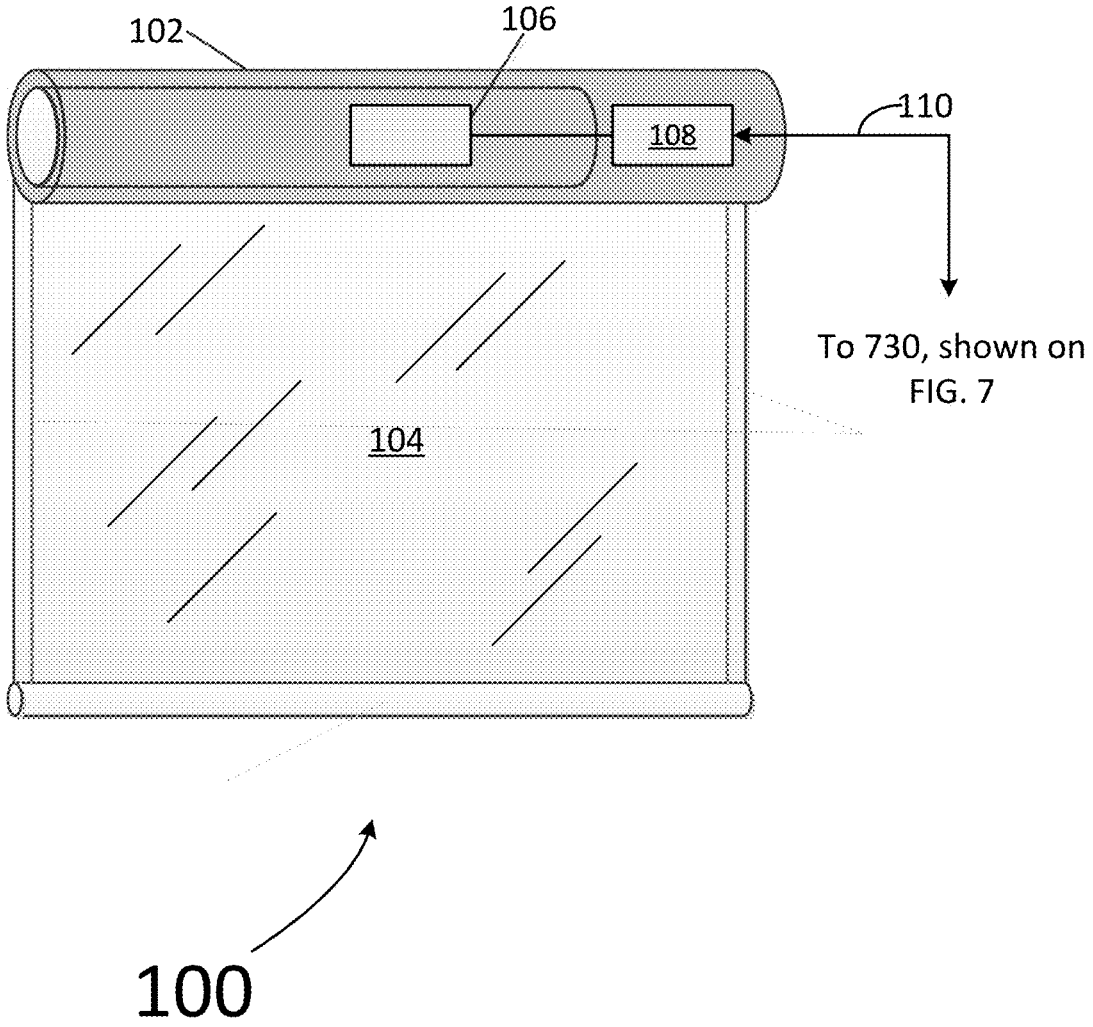
FIG. 1 illustrates a roller shade system that includes a motor controlled by a motor controller according to aspects of the embodiments.

The embodiments are described more fully hereinafter with reference to the accompanying drawings, in which aspects of the embodiments are shown. In the drawings, the size and relative sizes of layers and regions may be exaggerated for clarity. Like numbers refer to like elements throughout. The embodiments may, however, be embodied in many different forms and should not be construed as limited to the embodiments set forth herein. Rather, these embodiments are provided so that this disclosure will be thorough and complete, and will fully convey the scope of the aspects of the embodiments to those skilled in the art. The scope of the embodiments is therefore defined by the appended claims. The detailed description that follows is written from the point of view of a control systems company, so it is to be understood that generally the concepts discussed herein are applicable to various subsystems and not limited to only a particular controlled device or class of devices, such as roller shades.

Reference throughout the specification to "one embodiment" or "an embodiment" means that a particular feature, structure, or characteristic described in connection with an embodiment is included in at least one embodiment of the embodiments. Thus, the appearance of the phrases "in one embodiment" or "in an embodiment" in various places throughout the specification is not necessarily referring to the same embodiment. Further, the particular feature, structures, or characteristics may be combined in any suitable manner in one or more embodiments.

For over 40 years Creston Electronics Inc., has been the world's leading manufacturer of advanced control and automation systems, innovating technology to simplify and enhance modern lifestyles and businesses. Crestron designs, manufactures, and offers for sale integrated solutions to control audio, video, computer, and environmental systems. In addition, the devices and systems offered by Crestron streamlines technology, improving the quality of life in commercial buildings, universities, hotels, hospitals, and homes, among other locations. Accordingly, the systems, methods, and modes of the aspects of the embodiments described herein, can be manufactured by Crestron Electronics Inc., located in Rockleigh, N.J.

LIST OF REFERENCE NUMBERS FOR THE ELEMENTS IN THE DRAWINGS IN NUMERICAL ORDER

The following is a list of the major elements in the drawings in numerical order.

100 Roller Shade System with Motor
102 Roller Tube
104 Shade
106 Motor
108 Motor Controller
110 Cresnet Cable (Cable; RS485 & Power)
204 LED/Buttons
206 Input/Output (IO)
208 Slave Communications Interface (IF)
210 RS485 Transceiver
212 24 Volts Alternating Current (VAC) Polarity Protector
214 Limits Electrically Erasable Programmable Read Only Memory (EEPROM)
216 Motor Power Motion Control (MPMC) Application (App)
218 Master Micro-controller Unit (MMCU)
220 24 VAC Current Sense
222 3.3 Voltage Direct Current (3.3 VDC) Regulator
224 Position EEPROM
226 Slave MCU (SMCU)
228 5 VDC Power Supply
230 Motor Drive
231 Three Phase (3ϕ) Synthesized Sinusoidal Waveform Generator
232 Phase and Current Detector
234 Hall Effect Sensor
600 Method for Determining Motor Motion Control Parameters
602—
618 Method Step of Method 600
700 Network System
702 Mobile Device
704 Personal Computer (PC)
706 Internet Service Provider (ISP)
708 Modulator/Demodulator (Modem)
710 Wireless Router
712 Plain Old Telephone Service (POTS) Provider
714 Cellular Service Provider
718 Communications Satellite
720 Cellular Tower
722 Internet
724 Global Positioning System (GPS) Station
726 Satellite Communication Systems Control Stations
728 GPS Satellite
730 Cresnet Transceiver

LIST OF ACRONYMS USED IN THE SPECIFICATION IN ALPHABETICAL ORDER

The following is a list of the acronyms used in the specification in alphabetical order.

App Application
BT Blue Tooth
DC Duty Cycle
EEPROM Electrically Erasable Programmable Read Only Memory
GPS Global Positioning System
IF Slave Communications Interface
IO Input/Output
ISP Internet Service Provider
LED Light Emitting Diode
MMCU Master Micro-controller Unit
Modem Modulator/Demodulator
MPMC Motor Power Motion Control
NFC Near Field Communications
PC Personal Computer
PID Proportional Integral Derivative POTS Plain Old Telephone Service
RPM Revolutions per Minute
SMCU Slave Micro-controller Unit
VAC Volts Alternating Current
VDC Volts Direct Current According to aspects of the embodiments, the system and method described herein provides for the selection of motor motion parameters that fine tune the control of a roller shade motor. Large, heavy roller shades require a motor with a significant amount of power and starting torque to get the large, heavy shade moving in a smooth, non-jerky motion, and then keep it moving at the desired opening/closing speed. Small, lighter roller shades require a motor with less power, but which can be adjusted or operated in such a manner so as to avoid jerky motions. In addition, motors for both heavy and light shades need to be operated in a smooth manner, but still keep up with any unexpected torque variations given friction and mechanical wear and/or environmental changes.

According to aspects of the embodiments, the system and method described herein can detect the load on the roller shade motor, and then classify the shade as belonging to one of N groups. For each of the N groups of shades (primarily based on weight), there will exists a set of near optimum parameters for operating the motor. Some of these parameters are linear, but some of them belong to non-linear compensators. According to aspects of the embodiments, in a scenario where there are multiple, different load/size shades, the behaviors of the motors for each of the N groups, when using the system and method according to aspects of the embodiments, will be more homogenous and uniform as opposed to only having parameters to compensate for the heaviest case. The motor in the roller shade system operated in accordance with aspects of the embodiments will be able to control both light and heavy shades in a substantially uniform and smooth manner.

According to further aspects of the embodiments, empirical data can be obtained from existing/working prototype shade motors, from which can be obtained working datasets of current consumption waveforms and phase differential information over the travel of the roller shade for various loads (in both upwards and downward rotation directions). With this information, according to aspects of the embodiments, mathematical models can be created that can tell, with a small margin of error, what is the torque load at any given time on the shade during travel of the roller shade.

According to aspects of the embodiments, there are at least several ways in which the load of a shade can be ascertained. By way of non-limiting example, and as briefly discussed above, the current used by the roller shade motor can be used to determine the load of the roller shade. According to aspects of the embodiments, the system and method as described herein can measure the current waveform for a predetermined period of time as the shade travels up against gravity, and then the system and method can then use this current information (I) to calculate the shade torque (Load). According to further aspects of the embodiments, phase information (e.g., a phase differential) between the input power and shaft position can be used to determine the load of the roller shade. According to aspects of the embodiments, a phase shift can be determined between the current input to the motor and the output shaft position by measuring the phase of the current input to the roller shade motor, and ascertaining the relative position of the roller shade motor drive shaft through use of a Hall effect sensor located on the roller shade motor drive shaft. This phase shift can then be used in a lookup table to determine what the motor load torque is on motor 106.

With this load value, the system and method according to aspects of the embodiments will look into a stored database (table-driven values), to select what are the most one or more optimum parameters for the current load condition of the roller shade (the "load" condition can also be referred to as the motor load torque (value), or $\tau_v$). According to aspects of the embodiments, some of these parameters can include proportional, integrative, and derivative (PID) values, PID sample frequency, minimum speed, minimum power, commutation method, ramp-up and ramp-down boost values, motion parameters adjustments, among others. These parameters are discussed in greater detail below.

Attention is now directed towards FIG. 1. FIG. 1 illustrates roller shade system 100 that includes roller shade motor (motor) 106, motor controller (controller) 108 (which controls motor 106), roller tube 102 (which can house motor 106, controller 108, among other components), shade 104, and Cresnet cable (cable) 110, according to aspects of the embodiments. Cable 110 can be a combined RS485 cable with power lines, such as 24 volts direct current (VDC) for remotely powering devices, such as motor 106 and motor controller 108 according to aspects of the embodiments. Cable 110 can be connected to Cresnet transceiver 730, which is shown and discussed in greater detail in FIG. 7.

Figure 2:
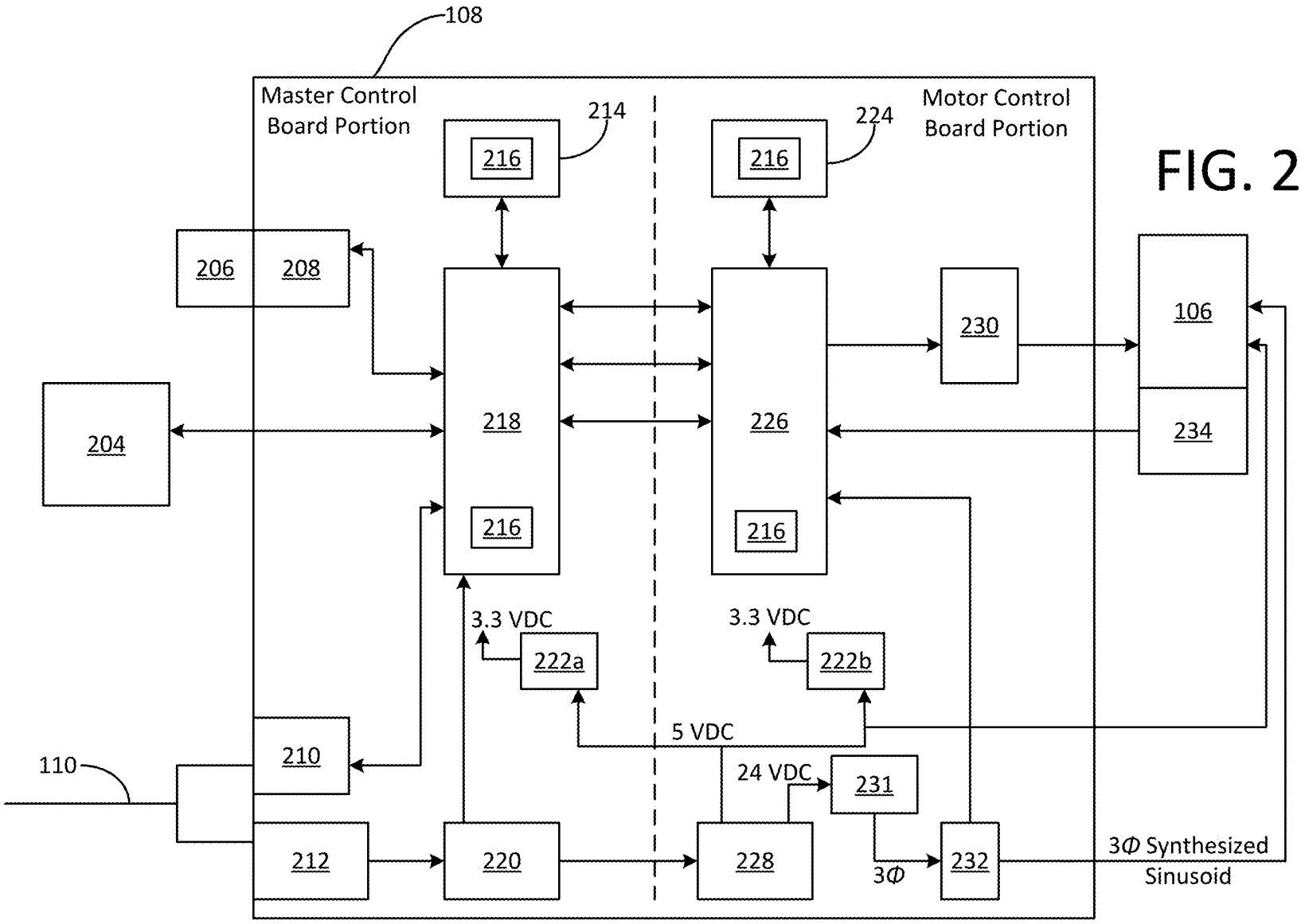
FIG. 2 illustrates a block diagram of a motor controller for use with the roller shade system of FIG. 1 according to aspects of the embodiments.

FIG. 2 illustrates a block diagram of motor controller 108 for use with roller shade system 100 of FIG. 1 according to aspects of the embodiments. According to aspects of the embodiments, motor controller (controller) 108 can be divided into two main boards: a master control board portion, and a motor control board portion, though that need not necessarily be the case. As described in greater detail below, there is a master central processing unit, and a slave central processing unit (CPU). The master CPU can be a "Business Logic" processor that communicates with, according to aspects of the embodiments, a Crestron control system, handles the user interface, and feeds high level commands to the motor via the slave CPU. According to further aspects of the embodiments, the slave CPU can be a brushless direct current (BDLC) advance motor controller, and it handles the low level details of controlling the motor motion variables, keeping motion parameters, motor state, reading sensors and generating complex waveforms to control the motor in the best way possible. As those of skill in the art can appreciate, the functions performed by the slave CPU can also be designed to reside on the master CPU, but then there are a significant amount of operations on one processor, and this increases the risk and memory requirements, as well as reliance on a single vendor. In fulfillment of the dual purposes of clarity and brevity, however, discussion shall only be made herein of the case in which controller 108 has been divided into two boards. On the master control board portion, there is located slave communication interface (IF) 208, which receives input information and data and outputs information and data to input/output circuitry (IO) 206. IF 208 is in communication with master microcontroller unit (MMCU) 218. MMCU 218 includes at least one or more microprocessors or microcontrollers, as well as internal memory, within which can reside motor power motion control (MPMC) application (App) 216.

According to aspects of the embodiments, MPMC App 216 is software code that comprises and embodies method 600, discussed and described in greater detail below in regard to FIG. 6. MPMC App 216 can also reside in Limits electrical erasable programmable read only memory (Limits EEPROM) 214, which is also in communication with MMCU 218 according to aspects of the embodiments. Also shown in FIG. 2 as part of the master control board portion of controller 108 are RS 485 transceiver (transceiver) 210, and 24 VAC polarity protector 212. The former, transceiver 210, is responsible for RS485 communications between Cresnet network transceiver 730 (shown and described in regard to FIG. 7) and controller 108, and ultimately motor 106, via Cresnet cable (cable) 110.

VAC polarity protector 212 receives both data and power from cable 110, and "strips" the data away, leaving just the power on the line output of VAC polarity protector 212, which can be 24 VDC. The 24 VDC is sent to 24 VDC current sense circuit (current sense circuit) 220, which senses, or measures, the amount of current flowing in the 24 VDC line. The 24 VDC is sent to 5 VDC supply 228, which generates 5 VDC for use on both of the master control board portion of motor controller 108, and motor control board portion of motor controller 108. The 5 volts DC is used by at least 3.3 VDC regulators 222*a*, and 222*b*, the former of which generates 3.3 VDC for use on the master control board portion of motor controller 108, and the latter of which generates 3.3 VDC for use on the motor control board portion of motor controller 108. The 24 VDC power also passes through 5 VDC supply 228 and is sent to three phase (3ϕ) synthesized sinusoidal waveform generator 231, which generates a three phase synthesized sinusoid for use as a primary source of electrical power for motor 106. The three-phase synthesized sinusoid is passed through phase and current detector 232, which measures the phase of the three-phase synthesized sinusoid power voltage sent to motor 106, and the current as well as it enters motor 106. The phase detected here can be used with the output of Hall effect sensor 234, as described in greater detail below, to determine the load or torque on motor 106 according to aspects of the embodiments. The current measured by phase and current detector 232 can be used as an indicator of the load, or torque on motor 106 according to aspects of the embodiments. That is, MPMC App 216 can use a pre-determined look-up table, by finding the same or substantially similar current measurement to a matching load, and then adjust parameters of motor 106 found in the look-up table, so that substantially smooth and efficient operation of motor 106 occurs based on the pre-determined parameters. Examples of the look-up table according to aspects of the embodiments are shown and discussed in greater detail below.

Further included on the motor control board portion of motor controller 108 is slave MCU (SMCU) 226. SMCU 226 includes at least one or more microprocessors or micro-controllers, as well as internal memory, within which can reside MPMC App 216. According to aspects of the embodiments, MPMC App 216 is software code that comprises method 600, discussed and described in greater detail below in regard to FIG. 6. MPMC App 216 can also reside in Position EEPROM 224, which is also in communication with SMCU 226 according to aspects of the embodiments. SMCU 226 and MMCU 218 communicate and interface with each other through at least three sets of data/command/control lines, as indicated in FIG. 2 according to aspects of the embodiments. As those of skill in the art can appreciate, such inter-controller unit communication paths are known to those of skill in the art, and therefore, in fulfillment of the dual purposes of clarity and brevity, a detailed discussion thereof has been omitted from herein. SMCU 226—and MPMC App 216—also accepts as inputs the output of 24 VAC phase detector 232, and the output of Hall effect sensor 234, the latter of which is attached to the output shaft (not shown) of motor 106 according to aspect of the embodiments.

Motor drive 230 accepts command and control signals from Slave MCU 226, and translates the same to commands that are then transmitted to and readily understood by motor 106. The commands received and transmitted by motor drive 230 dictate the speed and direction of motion of the shaft of motor 106 in accordance with aspects of the embodiments, including determining a best set of motor control characteristics based on sensed current, and/or phase differences between the 24 VAC input current and position of the shaft of motor 106, according to aspects of the embodiments.

Figure 3:
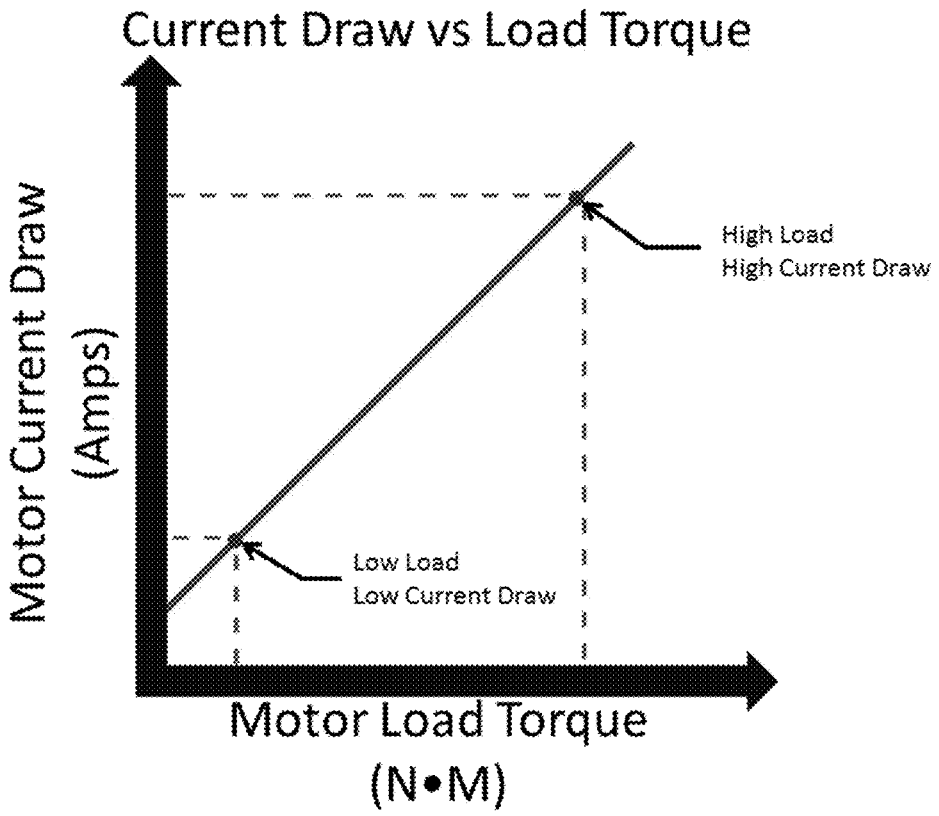
FIG. 3 illustrates a graph showing the relationship between motor current draw and motor load torque.

As described above, and according to aspects of the embodiments, there are at least two methods in which to determine the motor load torque on motor 106. The first method comprises measuring the current used by motor 106, and using a graph similar to that of FIG. 3 to ascertain the motor load torque. As can be seen in FIG. 3, the current versus torque relationship is substantially linear; that is, as the torque increases, the current draw will increase in a linear manner. According to aspects of the embodiments, the system and method can measure the current waveform for a predetermined period of time as shade 104 travels up against gravity, and then the system and method can then use this current information (I) to calculate the shade torque load.

Figure 4:
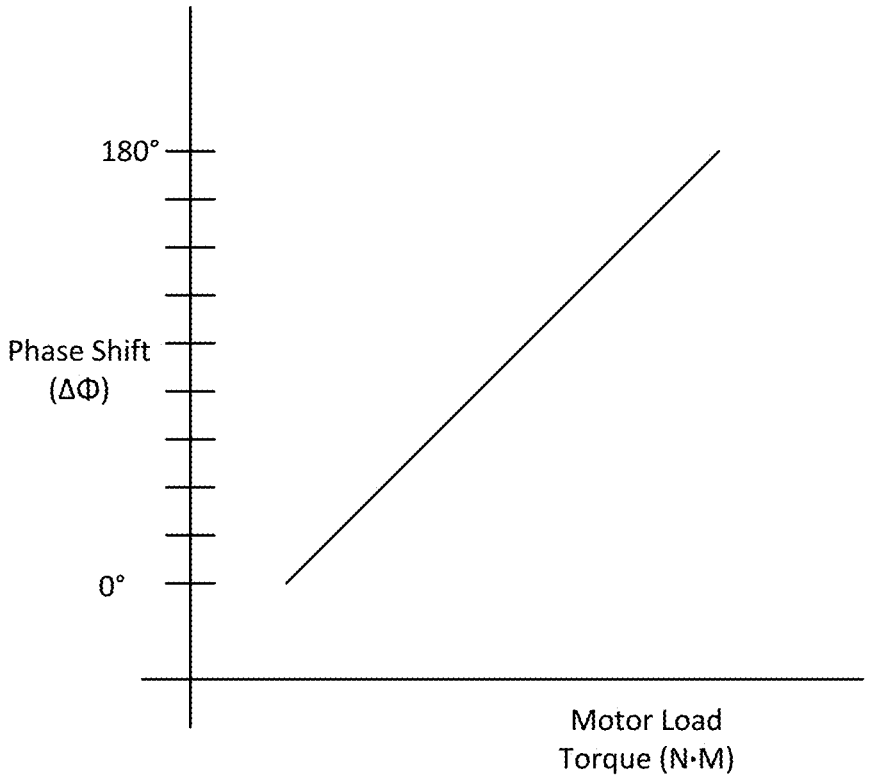
FIG. 4 illustrates a graph showing the relationship between a phase shift differential between alternating current input power to a motor and shaft position versus motor load torque.

According to further aspects of the embodiments, delta phase information ($\Delta\phi=|\phi_{Hall\ Effect}-\phi_{24VAC}|$) between the shaft position and 24 VAC input power can be used to determine the load of roller shade 104, as shown in FIG. 4. According to aspects of the embodiments, the phase shift ACP can be determined between the current input to the motor (e.g., 24 VAC) and the output shaft position by measuring the phase of the current input to roller shade motor 106, and ascertaining the relative position of the roller shade motor drive shaft through use of a Hall effect sensor located at the roller shade motor drive shaft. This phase shift ACP can then be used in a lookup table, or a graph similar to that shown in FIG. 4, to determine what the motor load torque is on motor 106.

Attention is now directed towards FIG. 5, which illustrates a look-up table for determining motor motion parameters, $MP_N$, based on motor load torque according to aspects of the embodiments. According to aspects of the embodiments, once the motor load torque value is obtained, whether by the current measurement process, or the phase differential process, as described herein, or another process, the obtained motor load torque value can then be used to acquire the previously determined and recorded motor motion control parameters that will best operate motor 106 to move shade 104 in the best manner possible, without jerking shade 104, or moving shade 104 too fast or too slow. Further, as those of skill in the art can now readily appreciate, method 600 need only be performed once upon the first installation of shade 104; though, as can be appreciated, re-calibrating the motor motion parameters from time-to-time can also be beneficial.

With this load value, the system and method according to aspects of the embodiments will look into a stored database (table-driven values), to select what is the most optimum parameters for the current load condition of the roller shade. According to aspects of the embodiments, these parameters can include proportional, integrative, and derivative (PID) values, PID sample frequency, minimum speed, minimum power, commutation method, ramp-up and ramp-down boost values, motion parameters adjustments, among others. According to further aspects of the embodiments, not every one of the motor motion control parameters needs to be applied or changed when a different motor torque load is encountered. According to still further aspects of the embodiments, both methods of determining the motor load torque can be used, and the current results averaged, or weighted in multiple and different manners.

As those of skill in the art can appreciate, PID is used as a control algorithm by most motion control applications. While it has been shown that in some circumstances, a motor can be controlled by only one or two of the PID values, in many more sophisticated applications, the system will be designed to include all three of the PID values. As those of skill in the art can further appreciate, the proportional term (P) affects the overall response of the system to a position error. The integral term (I) is needed to force the steady state position error to zero for a constant position command, and the derivative term (D) is needed to provide a damping action, as the response becomes oscillatory. Further, because all three parameters are inter-related, adjusting one parameter will affect any of the previous parameter adjustments. As those of skill in the art can further appreciate, P accounts for present values of the error. For example, if the error is large and positive, the control output will also be large and positive. I accounts for past values of the error. For example, if the current output is not sufficiently strong, the integral of the error will accumulate over time, and the controller will respond by applying a stronger action. D accounts for possible future trends of the error, based on its current rate of change.

According to aspects of the embodiments, the P term is modified to increase as the load gets bigger (the variation between the lightest and the heaviest load could be up to 50% variation in the P constant). As the load increases, the P term makes the reaction of motor controller 108 become more aggressive; thus, P is variable and dependent upon load.

According to further aspects of the embodiments, I, the integral constant is fined tuned for very particular convergence time, and to keep a great deal of stability in system behavior by tuning the output motion behavior to be critically or hard damped. The Integral term reduces the residual steady state error. According to further aspects of the embodiment, the I term is also variable and dependent on the load. According to still further aspects of the embodiments, there are at least three separate I values, i.e., for four separate load regions. However, as those of skill in the art can appreciate, there is no particular limit as to how many regions of differentiations of load that can be used. As described herein, there could be one, two, or twenty or more separate load regions (e.g., the "pre-set" values described in reference to FIG. 6), but in regard to a particular implementation, and not to be taken in a limiting manner, the load has been divided into three regions. This also aids in making the description more limited and thus relatively easier to understand. According to further aspects of the embodiments, breaking the expected load regions into a smaller set such as four reduces risk, wherein risk can be defined as a level of probability that the chosen motor can perform adequately under expected load or torque conditions. Thus, according to aspects of the embodiments, a first I value, $I_1$, is used for light shades, a second I value, $I_2$, is used for medium weight shades (this provides smooth motion behavior for most intermediate loads), and a third I value, $I_3$, is used for the heavy shades. According to further aspects of the embodiments, $I_2$ is lower in value for the intermediate load cases, and slight higher for low and high loads (first ($I_1$) and third ($I_3$) terms, respectively). According to aspects of the embodiments, for lower loads, any change in power to the motor is quickly reflected in the motion of shade 104, so some dynamic delay needs to be dynamically injected to avoid instantaneous strong reactions (thus, lower loads get a larger I, $I_1$). For high load, e.g., larger, heavier shades 104, hard damping is desired as the system has more momentum and energy. However, there is also much more friction from other mechanical components under the heavier loads. Thus, providing a larger I value for the larger loads ($I_3$) helps maintain smooth reactions in regard to substantially instantaneous changes in torque/speed.

According to further aspects of the embodiments, the derivative term, D, is held constant at 0 for small and mid-size loads. A first D term, $D_1$, is adaptively added to high load shades when their reaction time is slow and abnormal. According to aspects of the embodiments, a typical reaction time shade motor 106 is defined as getting to about 95% of the reference speed value change of about 1 rpm within about ½ second. According to further aspects of the embodiments, reaction times that have a slower convergence value than the about ½ second reaction time is considered "slow" reacting.

According to aspects of the embodiments, the D term works a power booster relative to the error signal.

According to further aspects of the embodiments, the PID sampling frequency can be changed dependent upon shade load. As those of skill in the art can appreciate, the PID sampling frequency is the frequency at which the measurable variables that are used in the PID algorithm are sampled. According to aspects of the embodiments, the sampling frequency can directly affect how motor 106 generates some audible sounds as it changes power levels for adjusting speed regulation versus load. Thus, if during normal operation the PID sampler (which is part of SMCU 226) detects a high level of constant abrupt changes (i.e., the abrupt changes happen with increasing regularity), the PID sampler will increase the sampling frequency. According to further aspects of the embodiments, the PID sampler can adapt the sampling frequency to be performed at about 100 hz, 200 hz, and 400 hz A further variable that can be changed in accordance with the shade motor load is the motor commutation method. According to aspects of the embodiments, in a BLDC motor, such as motor 106, a trapezoidal commutation method can be used, as it injects a good deal of power to motor 106 at the cost of having torque ripple and higher noise as the shade motor load and speed increase. According to aspects of the embodiments, the trapezoidal commutation method can be used when there are very heavy shades, and for cases where motor stalls are detected on steady runs. For midsize shades 104, the systems and methods according to aspects of the embodiments can use a sinusoidal plus third harmonic commutation method that offers a very silent motor operation compared to torque ripple. While the sinusoidal plus third harmonic commutation method injects less power overall to motor 106, it keeps the torque ripple to a minimum. In regard to very light shades, a simple sinusoidal commutation method keeps operation of shade motor 106 substantially silent, but it also injects the least amount of power compared to the other two methods.

A further variable that can be changed in accordance with the shade motor load is the minimum speed and minimum power for motor 106. The minimum speed and minimum power for motor 106 are a function of one or more of the motor shade load, the above described motor parameters, and commutation method. According to aspects of the embodiments, as the load on the shade increases, the minimum operating motor speed needs to be increased. According to aspects of the embodiments, using lower minimum operating speeds on lighter shades avoids jerky motion on slow moving heavier shades. According to further aspects of the embodiments, the commutation method can also be changed over the range of load, and this will cause a different set of values for the minimum operating speeds, but which is still a function of load, e.g., higher loads require higher minimum operating speeds than lower loads, which require lower minimum operating speeds, in both cases to cause substantially smooth operation.

According to further aspects of the embodiments, for heavier loads, it is necessary to modify the Ramp-up profile, injecting a certain amount of non-linear value to start the motion (for the raise direction); this is similar to the D factor in the PID, but, according to aspects of the embodiments, it has been isolated from the PID controller, and allocated as an extra Ramp-up boost feature.

According to still further aspects of the embodiments, it has been determined that in order to keep the deceleration motion smooth and uniform across all loads, a different deceleration pattern can be applied adaptively to each load region. This feature acts as a break on the motion of motor 106 and keeps its motion smooth and linear; however, while the motion remains substantially smooth and linear, the parameters that are controlling the motion of motor 106 are linearly scaled. According to aspects of the embodiments, heavy loads require longer time to break, or slow down, and therefore require additional time to prior to beginning a normal ramp-down to a predetermined stop. For relatively smaller, lighter shades, the ramp-down profile is substantially linear and as speed increases, the time to stop scales substantially gradually. For heavier shades, the pattern approximates an exponential function; as the speed increases, the ramp-down time is considerably longer.

According to still further aspects of the embodiments, at least one or more of the parameters discussed above can be adaptively applied with different values depending on whether the shade is being raised or lowered. For example, the values for PID in the lowering direction must compensate for gravity. Also, given that most of the mechanical components are not under strong load when the shade is being lowered, the PID parameter, minimum speed, and ramp-down/ramp-up parameters are managed in a more linear and proportional manner when the shade is being lowered, than being raised.

Attention is now directed towards FIG. 6, which illustrates method 600 for selecting and implementing power and motion parameters of a roller shade motor such that a single roller shade motor can be used for raising and lowering a plurality of different roller shades of different weights and sizes, fluidly and without faulty operation, substantially regardless of the size and weight of the roller shade. Method 600 can control motor 106 of roller shade 100 using the motor controller 108. Method 600 begins with method step 602, in which shade motor 106 is engaged for upward motion according to aspects of the embodiments. The reason upward motion is chosen is that this direction provides the greatest motor load torque, when the motor is working against the force of gravity. According to further aspects of the embodiments, however, motor 106 can move shade 104 downwards a short distance to obtain a best set of motor motion parameters. In method step 604, the shade motor torque is obtained, using either or both of a current measurement technique, or phase differential technique, as previously described herein, via one or both of the graphs. According to aspects of the embodiments, the shade motor torque value can be obtained in the following manner; shade 104 is twice lowered and raised to its lower and upper limits, respectively, and the current values obtained, and then averaged. The resultant averaged current value is then used to find the appropriate torque value in the current-torque tables, in the manner described above.

In decision step 606, method 600 determines whether the measured motor load torque is less than a first predetermined (or pre-set) value $\tau_1$: if it is ("Yes" path from decision step 606), method 600 proceeds to step 608 and obtains a first set of motor motion parameters, $MP_1$, and applies them to motor 106 according to aspects of the embodiments. According to aspects of the embodiments, $\tau_1$ can be about 0.35 newton-meters (nm), and can range from about 0.315 nm to about 0.385 nm. In the discussion below, reference is made to PID values that include terminology such as "soft," "mid," and "strong." "Soft" PID values are those that pertain to the lightest range of shade loads; "Mid" PID values are those that pertain to a medium range of shade loads; and "Strong" PID values are those that pertain to a heaviest range of shade loads.

According to aspects of the embodiments, and by way of a non-limiting example only, the first set of motor motion parameters, $MP_1$, to use with a motor load torque of $\tau_1$ can include the following: (1) the PID values can be a "soft" set of values (2) the PID sampling frequency can be set to 100 hz, (3) the minimum speed can be set to be about 10 revolutions per minute (RPM), (4) the minimum power can be set to be about 20 watts, (5) the commutation method used can be a substantially pure sine drive method (to effect silent operation), (6) the ramp-up boost can be set to be about 25 RPM+10 Watts boost, and (7) the ramp-down boost can be set to be about also to 25 RPM. In addition, the duty cycle (DC) value can be set to be very long. As those of skill in the art can appreciate, the DC is the amount of time motor active vs the amount of time the motor rests before continuing the cycle ("on-off," "on-off," and so on; the ratio of "on-time" to total time (on-time plus off-time) is the duty cycle or "DC"). Limiting the DC of the motor extends the operational life of the motor, as it tends to heat up if operated completely on for extended periods of time; heat continues to build if operated continuously. Thus, operating the motor according to a DC of on/(total time) allows heat energy to dissipate.

As those of skill in the art can appreciate, motors will have a design-driven heat-energy dissipation factor. Ultimately, pulsing the motor on-and-off extends the operating life of the shade motors. According to further aspects of the embodiments, motors that raise and lower lighter shades will experience extended operating "on" times with little rest, and motors that raise and lower heavier shades will experience extended operating "off" times with little "on" times. According to further aspects of the embodiments, another parameter of the motor that can be set is the manner in which voltage is applied. As described above, one such method is a trapezoidal wave form, while another is a sinusoidal waveform. Other waveforms can be used as well. According to further aspects of the embodiments, the first set of motor motion parameters, $MP_1$, can include a short period of a trapezoidal voltage waveform, e.g., about 50 ms, before switching to a sinusoidal waveform.

If, however the measured motor load torque is greater than the first pre-set value, $\tau_1$, ("No" path from decision step 606), then method 600 proceeds to decision step 610.

In decision step 610, method 600 determines whether the measured motor load torque is greater than the first pre-set value, $\tau_1$ and less than a second pre-set value, $\tau_2$ (i.e., is the measured motor load torque between the first and second pre-set values?): if it is ("Yes" path from decision step 610), method 600 proceeds to step 612 and obtains a second set of motor motion parameters, $MP_2$, and applies them to motor 106 according to aspects of the embodiments. According to aspects of the embodiments, $\tau_2$ can be about 0.6 nm, and can range from about 0.54 nm to about 0.66 nm. According to aspects of the embodiments, and by way of a non-limiting example only, the second set of motor motion parameters, $MP_2$, to use with a motor load torque between about $\tau_1$ and about $\tau_2$ can include the following: (1) the PID values can be a "mid" set of values (2) the PID sampling frequency can be set to about 150 Hz, (3) the minimum speed can be set to be from about 14 RPM to about 15 RPM, (4) the minimum power can be set to be about 35 watts, (5) the commutation method used can be a sine wave with third harmonics (to effect silent operation), (6) the ramp-up boost can be set to be about 25 RPM+about 15 watts, and (7) the ramp-down boost can be set to be about 20 RPM. In addition, the DC value can be set to be long, and the trap value set to be mid. A "mid" trapezoidal value is one in which the DC is about 50%, and the trap start is set to be between about 50 ms to about 100 ms.

If, however the measured motor load torque is greater than both the first, $\tau_1$, and the second, $\tau_2$, pre-set values ("No" path from decision step 610), then method 600 proceeds to decision step 614.

In decision step 614, method 600 determines whether the measured motor load torque is greater than the second pre-set value, $\tau_2$, and less than a third pre-set value, $\tau_3$ (i.e., is the measured motor load torque between the second and third pre-set values?): if it is ("Yes" path from decision step 614), method 600 proceeds to step 616 and obtains a third set of motor motion parameters, $MP_3$ and applies them to motor 106 according to aspects of the embodiments. According to aspects of the embodiments, $\tau_3$ can be about 0.75 nm, and can range from about 0.675 nm to about 0.825 nm.

According to aspects of the embodiments, and by way of a non-limiting example only, the second set of motor motion parameters, $MP_3$, to use with a motor load torque between about $\tau_2$ and about $\tau_3$ can include the following: (1) the PID values can be a "strong" set of values (i.e., a heavy load), (2) the PID sampling frequency can be set to be about 200 hz, (3) the minimum speed can be set to be about 16 RPM, (4) the minimum power can be set to be about 45 watts, (5) the commutation method used can be a sine wave with third and fifth harmonics (to effect silent operation), (6) the ramp-up boost can be set to be about 30 RPM, and (7) the ramp-down boost can be set to be about 15 RPM. In addition, the DC value can be set to be short, and trap start can be set to long.

In this case, a long trap start means that it will take about 150 ms for the motor to start. If, however the measured motor load torque is greater than the first, second and third, pre-set values ($\tau_1$, $\tau_2$, and $\tau_3$, respectively; "No" path from decision step 614), then method 600 proceeds to step 618. In step 618, method 600 obtains a fourth set of motor motion parameters, $MP_4$, and applies them to motor 106 according to aspects of the embodiments.

According to aspects of the embodiments, and by way of a non-limiting example only, the fourth set of motor motion parameters, $MP_4$, to use with a motor load torque greater than $\tau_3$ can include the following: (1) the PID values can be a "very strong" set of values, (2) the PID sampling frequency can be set to be about 200 hz, (3) the minimum speed can be set to be between about 17 and about 18 RPM, (4) the minimum power can be set to be about 50 watts, (5) the commutation method used can be a sine wave with harmonics (to effect silent operation; alternatively, the commutation method can also be set to be trapezoidal), (6) the ramp-up boost can be set to be about 20 RPM+20 watts, and (7) the ramp-down boost can be set to be aggressive and short. In addition, the DC value can be set to be very short. According to aspects of the embodiments, a very short DC means the "on-time" to "total time" ratio is about 1:10. According to further aspects of the embodiments, the trap start can be set to be very long. According to aspects of the embodiments, a "very long" trap start refers to the commutation method being set to be about 200 ms+ of running trapezoidal commutation at the start of the motor motion to gain momentum and then switching over to sinusoidal commutation As those of skill in the art can now readily appreciate, there is virtually no limit as to the number of pre-set values that can be used to set motor motion parameters. That is, instead of only four sets of motor motion parameters, method 600 could differentiate between forty sets of motor load torque values, or only two. According to aspects of the embodiments, the number of sets of values is not to be taking in a limiting sense.

Figure 7:
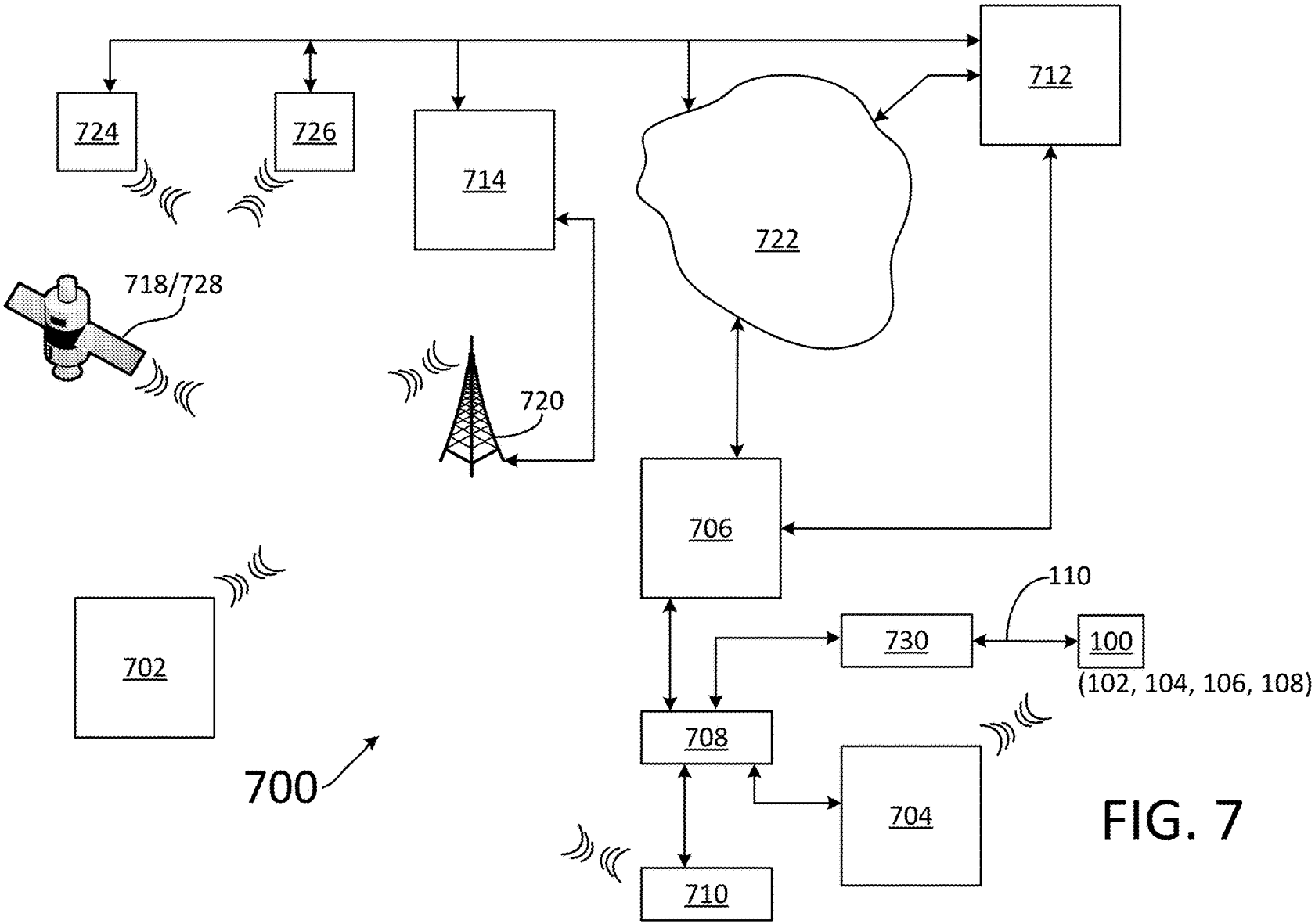
FIG. 7 illustrates a block diagram of a network within which the roller shade system of FIG. 1 can operate according to aspects of the embodiments.

FIG. 7 illustrates a block diagram of network 700 within which roller shade system 10 of FIG. 1 can operate according to aspects of the embodiments. Much of the network system infrastructure shown in FIG. 7 is or should be known to those of skill in the art, so, in fulfillment of the dual purposes of clarity and brevity, a detailed discussion thereof shall be omitted.

In FIG. 7, there is shown mobile device 702, which can access cellular service provider 714, either through a wireless connection (cellular tower 720) or via a wireless/wired interconnection (a "Wi-Fi" system that comprises, e.g., modulator/demodulator (modem) 708, wireless router 710, personal computer (PC) 704, internet service provider (ISP) 706, and internet 722). Mobile device 702 can include another App that can be used to control one or more of roller shade systems 100. Further, mobile device 702 can include near field communication (NFC), "Wi-Fi," and Bluetooth (BT) communications capabilities as well, all of which are known to those of skill in the art. To that end, network system 700 further includes, as many homes (and businesses) do, one or more PCs/servers 704 that can be connected to wireless router 710 via a wired connection (e.g., modem 708) or via a wireless connection (e.g., Bluetooth). Modem 708 can be connected to ISP 706 to provide internet based communications in the appropriate format to end users (e.g., PC 704), and which takes signals from the end users and forwards them to ISP 706. Such communication pathways are well known and understand by those of skill in the art, and a further detailed discussion thereof is therefore unnecessary.

Mobile device 702 can also access global positioning system (GPS) satellite 728, which is controlled by GPS station 724, to obtain positioning information (which can be useful for different aspects of the embodiments), or mobile device 702 can obtain positioning information via cellular service provider 714 using cell tower(s) 720 according to one or more well-known methods of position determination. Some mobile devices 702 can also access communication satellites 718 and their respective satellite communication systems control stations 726 (the satellite in FIG. 7 is shown common to both communications and GPS functions) for near-universal communications capabilities, albeit at a much higher cost than convention "terrestrial" cellular services. Mobile device 702 can also obtain positioning information when near or internal to a building (or arena/stadium) through the use of one or more of NFC/BT devices, the details of which are known to those of skill in the art. FIG. 7 also illustrates other components of network system 700 such as plain old telephone service (POTS) provider 712.

Roller shade system 100 can access and utilize network system 700 through Cresnet transceiver 730. Cresnet transceiver 730 comprises one or more processors, using known and understood technology, such as memory, data and instruction buses, and other electronic devices, to store and implement code (e.g., an App) that can implement the system and method for selected and implementing power and motion parameters of a roller shade motor based on load according to aspects of the embodiments.

The disclosed embodiments provide systems, methods, and modes for selecting and implementing power and motion parameters of a roller shade motor used in a roller shade system based on load, such that regardless of the load imposed by shade 104 on motor 106, a single motor can be used to smoothly and efficiently operate a plurality of different size and weight roller shades. It should be understood that this description is not intended to limit the embodiments. On the contrary, the embodiments are intended to cover alternatives, modifications, and equivalents, which are included in the spirit and scope of the embodiments as defined by the appended claims. Further, in the detailed description of the embodiments, numerous specific details are set forth to provide a comprehensive understanding of the claimed embodiments. However, one skilled in the art would understand that various embodiments may be practiced without such specific details.

Although the features and elements of aspects of the embodiments are described being in particular combinations, each feature or element can be used alone, without the other features and elements of the embodiments, or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

The above-described embodiments are intended to be illustrative in all respects, rather than restrictive, of the embodiments. Thus the embodiments are capable of many variations in detailed implementation that can be derived from the description contained herein by a person skilled in the art. No element, act, or instruction used in the description of the present application should be construed as critical or essential to the embodiments unless explicitly described as such. Also, as used herein, the article "a" is intended to include one or more items.

All United States patents and applications, foreign patents, and publications discussed above are hereby incorporated herein by reference in their entireties.

INDUSTRIAL APPLICABILITY

To solve the aforementioned problems, the aspects of the embodiments are directed towards systems, methods, and modes of a battery operated roller shade.

Alternate Embodiments

Alternate embodiments may be devised without departing from the spirit or the scope of the different aspects of the embodiments.

What is claimed is:

1. A method for adjusting a set of roller shade motor motion parameters of a shade motor for use in a roller shade, comprising:

engaging the shade motor to move the roller shade a first distance;

measuring a first torque level indicator in regard to a power supply voltage being supplied to the shade motor during movement of the roller shade through the first distance;

determining a first torque level based on the measured first torque level indicator;

obtaining a first set of roller shade motor motion parameters from a table based on torque levels; and applying the first set of roller shade motor motion parameters to the shade motor whenever the roller shade is directed to lift or lower the roller shade, wherein the first torque level indicator comprises:

a first phase shift difference measured between current input to a power supply voltage being supplied to the shade motor during movement of the roller shade over the first distance, and a shaft angular position, wherein a shaft is used to rotationally raise and lower the roller shade, and further wherein the steps of engaging and measuring comprise:

engaging the shade motor to lift the roller shade a first height and measuring a shade-up current level;

engaging the shade motor to lower the roller shade a second height and measuring a shade-down current level;

averaging the shade-up current level and shade-down current level to determine an average current level; and determining a shade motor torque level based on the average current level.

2. The method according to claim 1, wherein the first distance equals a first upward movement distance and a first downward movement distance.

3. The method according to claim 1, wherein the first torque level indicator comprises:

a first current level in the power supply voltage being supplied to the shade motor during movement of the roller shade over the first distance.

4. The method according to claim 3, wherein the table based on torque levels comprises:

a plurality of motor motion parameters for each of n different ranges of torque values.

5. The method according to claim 4, wherein the plurality of motor motion parameters comprise:

at least one of (a) a set of proportional, integrative, and derivative (PID) values, (b) a PID sampling frequency; (c) a minimum speed of the roller shade motor; a commutation method; (d) a ramp-up boost value; and (e) a ramp-damp boost value.

6. The method according to claim 1, wherein the table based on torque levels comprises:

a plurality of motor motion parameters for each of n different ranges of torque values.

7. The method according to claim 6, wherein the plurality of motor motion parameters comprises:

at least one of (a) a set of proportional, integrative, and derivative (PID) values, (b) a PID sampling frequency; (c) a minimum speed of the roller shade motor; a commutation method; (d) a ramp-up boost value; and (e) a ramp-damp boost value.

8. A method for adjusting a set of roller shade motor motion parameters of a shade motor for use in a roller shade, comprising:

engaging the shade motor to move the roller shade a first distance;

measuring a first torque level indicator in regard to a power supply voltage being supplied to the shade motor during movement of the roller shade through the first distance;

determining a first torque level based on the measured first torque level indicator;

obtaining a first set of roller shade motor motion parameters from a table based on torque levels; and applying the first set of roller shade motor motion parameters to the shade motor whenever the roller shade is directed to lift or lower the roller shade, wherein the first torque level indicator comprises:

a first phase shift difference measured between current input to a power supply voltage being supplied to the shade motor during movement of the roller shade over the first distance, and a shaft angular position, wherein a shaft is used to rotationally raise and lower the roller shade.

9. The method according to claim 8, wherein the steps of engaging and measuring comprise:

engaging the shade motor to lift the roller shade a first height and measuring a shade-up current level;

engaging the shade motor to lower the roller shade a second height and measuring a shade-down current level;

averaging the shade-up current level and shade-down current level to determine an average current level; and determining a shade motor torque level based on the average current level.

10. The method according to claim 8, wherein the first distance equals a first upward movement distance and a first downward movement distance.

11. The method according to claim 8, wherein the first torque level indicator comprises:

a first current level in the power supply voltage being supplied to the shade motor during movement of the roller shade over the first distance.

12. The method according to claim 11, wherein the table based on torque levels comprises:

a plurality of motor motion parameters for each of n different ranges of torque values.

13. The method according to claim 12, wherein the plurality of motor motion parameters comprise:

at least one of (a) a set of proportional, integrative, and derivative (PID) values, (b) a PID sampling frequency; (c) a minimum speed of the roller shade motor; a commutation method; (d) a ramp-up boost value; and (e) a ramp-damp boost value.

14. The method according to claim 8, wherein the table based on torque levels comprises:

a plurality of motor motion parameters for each of n different ranges of torque values.

15. The method according to claim 14, wherein the plurality of motor motion parameters comprises:

at least one of (a) a set of proportional, integrative, and derivative (PID) values, (b) a PID sampling frequency; (c) a minimum speed of the roller shade motor; a commutation method; (d) a ramp-up boost value; and (e) a ramp-damp boost value.

* * * * *